United States Patent [19]

Kisling

[11] 4,229,118

[45] Oct. 21, 1980

[54] SCREED SUPPORT

[76] Inventor: Russell L. Kisling, 1220 S. Third St., Beatrice, Nebr. 68301

[21] Appl. No.: 4,021

[22] Filed: Jan. 17, 1979

[51] Int. Cl.[2] ..... E01C 19/22

[52] U.S. Cl. ..... 404/72; 425/219; 404/118

[58] Field of Search ..... 404/118, 72, 119, 114, 404/120; 425/219; 249/34, 2; 52/743

[56] References Cited

U.S. PATENT DOCUMENTS

| | | | |
|---|---|---|---|
| 413,846 | 10/1889 | Chambers | 404/119 |
| 1,440,606 | 1/1923 | Johnston | 404/119 |
| 1,773,431 | 8/1930 | Mosel | 404/119 |
| 1,887,195 | 11/1932 | Dejoy | 404/118 |
| 2,110,413 | 3/1938 | Baily | 404/114 |
| 2,255,343 | 9/1941 | Baily | 404/114 |
| 2,542,979 | 2/1951 | Barnes | 404/114 |
| 2,584,459 | 2/1952 | Jackson | 404/114 |
| 2,599,330 | 6/1952 | Jackson | 404/114 |
| 3,008,388 | 11/1961 | Nave | 404/114 |

*Primary Examiner*—Nile C. Byers, Jr.

*Attorney, Agent, or Firm*—Zarley, McKee, Thomte, Voorhees & Sease

[57] ABSTRACT

An upstanding plate adapted for supporting one end of an elongated screed member has a flat bottom edge for sliding movement along a generally horizontal surface at the base of a foundation wall. The upstanding plate is connected to one end of the screed members so as to extend below the screed member and support the screed member above the horizontal surface. The screed member may be received within an open bottomed channel secured to the upstanding plate and the plate may be provided with a leading edge which tapers forwardly and downwardly toward the bottom edge. A second elongated screed member may be supported on the upstanding plate and extended through an opening therein for engagement against the foundation wall. A spacer bar maintains the upstanding plate in spaced relation from the foundation wall. The invention further contemplates the combination of the upstanding plate with a pair of screed members and a method of smoothing and finishing a newly poured surface using the upstanding plate and screed member of the invention.

16 Claims, 4 Drawing Figures

SCREED SUPPORT

BACKGROUND OF THE INVENTION

This invention is directed generally to an apparatus and method for supporting one end of an elongated screed member used for smoothing and finishing a newly poured surface and more particularly to an upstanding screed support plate having a flat bottom surface for sliding movement along a generally horizontal surface adjacent a foundation wall.

Smoothing and finishing a newly poured concrete surface has customarily involved an expensive and time-consuming process requiring considerable skill. It is desirable to do so however, since the operation results in a substantially improved concrete surface. By moving a vibrating screed across the top of a newly poured concrete surface, large material within the concrete settles to the bottom and the concrete is allowed to set in a manner which will prevent cracking and present a smoother surface.

To support the elongated screed members, it has been the common practice to drive two rows of stakes into the ground over which the concrete is to be poured. The stakes are precisely measured and leveled so that the tops thereof lie a fixed distance below the intended surface level of the floor being poured. Pipes may be then placed on the stakes with the transversely extended screed members being advanced in sliding relation longitudinally along the pipes. The cost of the stakes and the time for measuring and setting the stakes substantially increase the cost of installing such concrete floors.

SUMMARY OF THE INVENTION

The present invention is directed to an upstanding plate adapted to support one end of a pair of elongated screed members. The plate extends below the screed members to support them at a predetermined height and has a flat bottom surface for slidably engaging a horizontal ledge or surface at the base of a foundation wall. Accordingly, the present invention eliminates the requirement for stakes for supporting at least one end of the screed members.

The screed support plate may be provided with open bottomed channels extended transversely of the plate for receiving the elongated screed members. One of the channels is preferably extended through an opening in the plate for spacing the plate a fixed distance from the adjacent foundation wall in order to allow concrete to enter the space between the plate and wall. As the screed members are advanced across the newly poured concrete, the upstanding plate member slides along the ledge at the base of the foundation wall, thereby providing a wholly portable and removable means for supporting the screed members during the smoothing and finishing operation.

Accordingly, it is a primary object of the invention to provide an improved apparatus and method for smoothing and finishing a newly poured surface.

A further object is to provide an improved apparatus for supporting one end of an elongated screed member.

A related object is to provide a screed support member which is movable with the screed member and removable from the finished concrete upon conclusion of the finishing operation.

Finally, it is an object of the invention to provide an improved concrete finishing apparatus and method which include an upstanding screed support plate which is economical to manufacture, simple in construction, durable in use and efficient in operation.

DESCRIPTION OF THE PREFERRED EMBODIMENT

Figure 1:
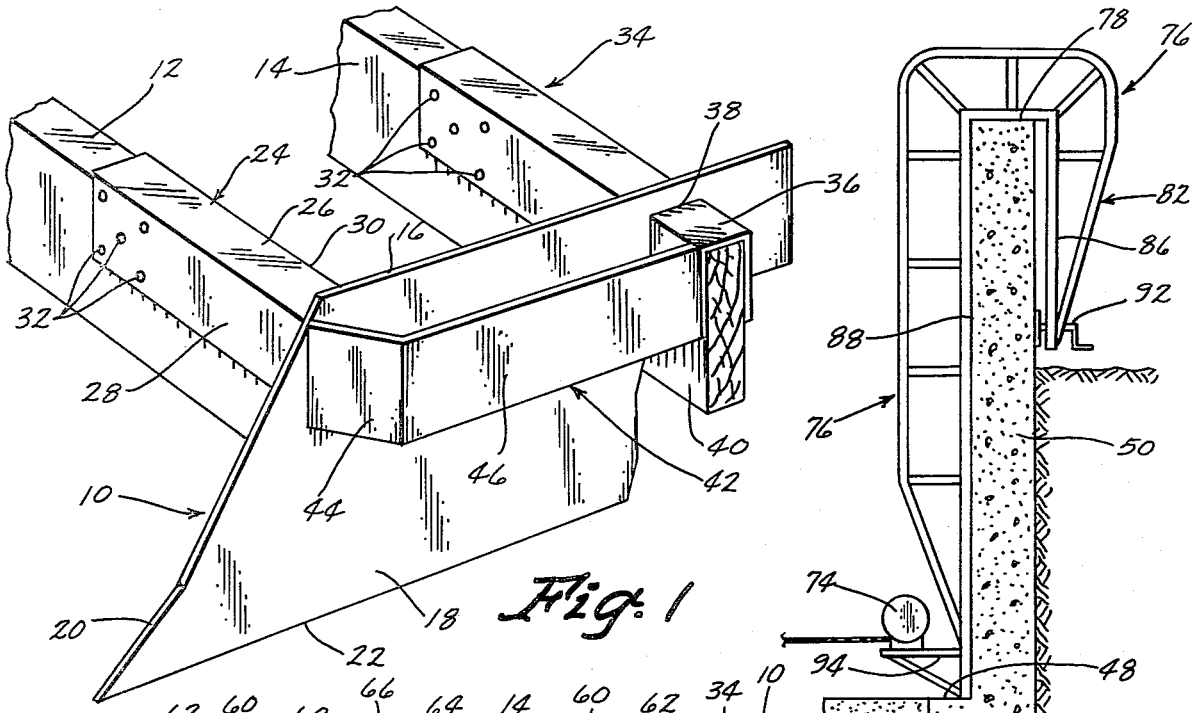
FIG. 1 is a perspective view of the screed support plate of the present invention with a pair of screed members secured thereto.

A screed support plate 10 of the present invention is shown in FIG. 1 with a pair of elongated screed members 12 and 14 supported thereon. Plate 10 is a generally flat upstanding plate having an inward side 16, an outward side 18, a leading edge 20 and a flat bottom edge 22.

To support the screed members 12 and 14 on the plate 10, a first open bottomed channel 24 is secured to the inward side 16 of plate 10 and extended inwardly therefrom at a perpendicular angle to the plate. Channel 24 has a top base 26 and a pair of depending side members 28 and 30 which may be approximately 3" in depth so that channel 24 is adapted to receive a wood plank screed member 12 of conventional dimensions, such as 2×6 and 2×8, for example. The side members 28 and 30 are provided with a plurality of nail holes as indicated at 32 through which nails are driven to secure the screed member 12 within channel 24 and against the plate 10.

To support the rearward screed member 14 on the plate 10, a second open bottomed channel 34 is fixed to the plate 10 rearwardly of channel 24. Channel 34 is of similar construction to channel 24 except that it is longer so as to protrude through the plate 10 beyond the outward side 18 as shown at 36 in FIG. 1. For this purpose, plate 10 is provided with a generally rectangular slot or opening 38 which is open at the bottom for receiving channel 34. The channels 24 and 34 in plate 10 may all be constructed of steel material so that they may be welded together or otherwise secured in fixed relation by any suitable means.

It will thus be noticed that rearward screed member 14 has an outward end portion 40 which protrudes outwardly of plate 10 to the outward end of channel 34 for engagement against a foundation wall situated along one side of the newly poured concrete floor. A spacer bar 42 (FIG. 1) extends forwardly from the outward end of the channel 34 both to reinforce the outward portion 36 of the channel and to prevent the outward portions 36 and 40 of the channel and rearward screed member from engaging obstructions as they are advanced along a foundation wall. Spacer bar 42 has a forward end 44 which is secured to plate 10 and extends rearwardly and outwardly therefrom for connection to an intermediate portion 46 which is disposed parallel to plate 10 and in spaced relation therefrom.

Figure 2:
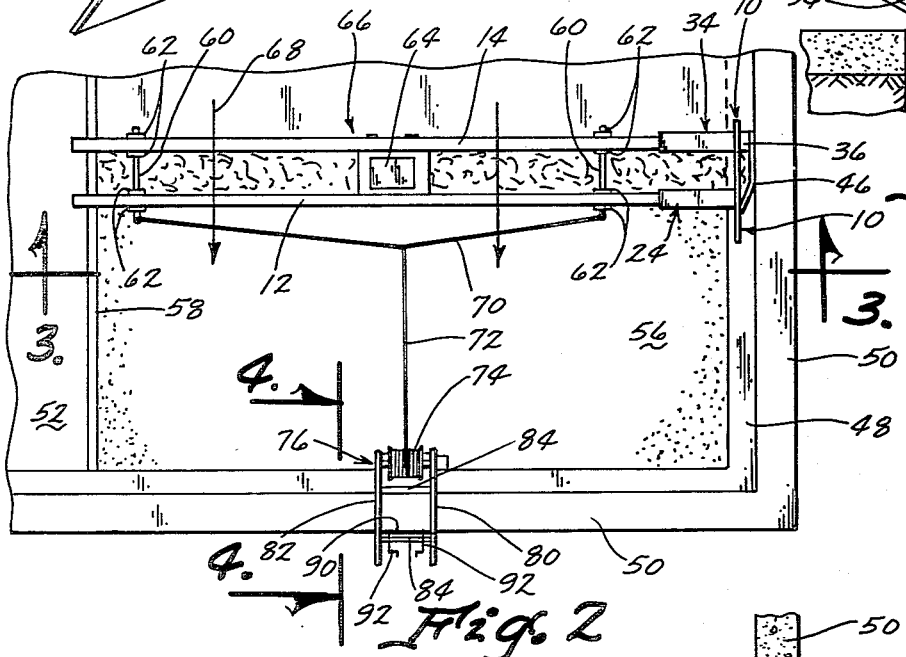
FIG. 2 is a partial top plan view of a screed of the present invention being advanced across a newly poured concrete surface in a building basement.
Figure 3:
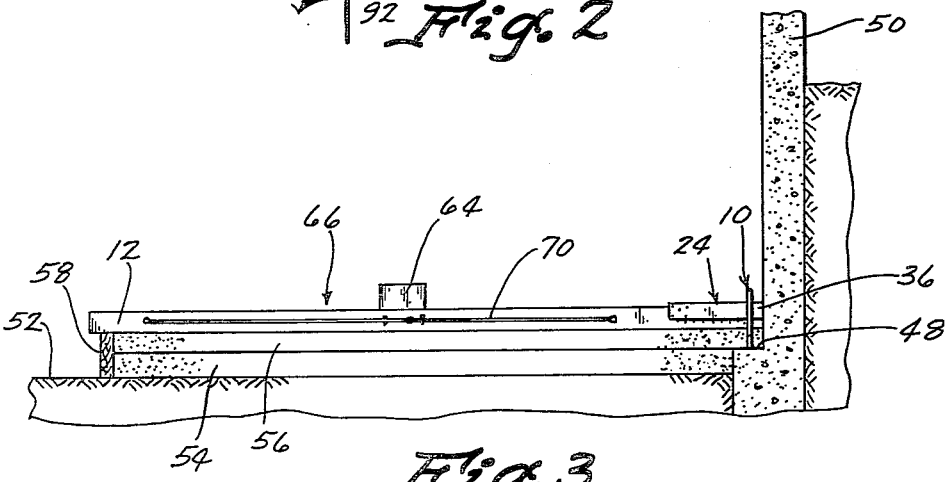
FIG. 3 is a front sectional view of the screed in operation, as seen on line 3—3 in FIG. 2.

Referring to FIGS. 2 and 3, it can be seen that the screed support plate 10 is positioned to rest on a footing or inwardly extended horizontal surface 48 at the base of a foundation wall 50. Horizontal surface 48 is situated slightly above the interior ground surface 52 which is covered by a layer of sand 54 to smooth out irregularities in the ground surface. Newly poured concrete 56 overlies the sand 54 and is contained on one side by the foundation wall 50 and on the other side by a concrete form 58 or any other suitable means. If the floor surface is of a relatively narrow width such that it may be spanned by a single screed member, another screed support plate may be used to support the other ends of the screed members. The other screed support plate would be constructed as the mirror image of plate 10 so that both would have leading edges facing in the same direction.

In FIG. 2, it can be seen that elongated screed members 12 and 14 are secured in generally parallel spaced-apart relation by elongated bolts 60 on which nuts 62 are secured in engagement against the respective screed members. A vibrator motor, indicated generally at 64, is centrally supported on the screed members 12 for vibrating the screed members in a manner commonly known to those skilled in the art.

Figure 4:
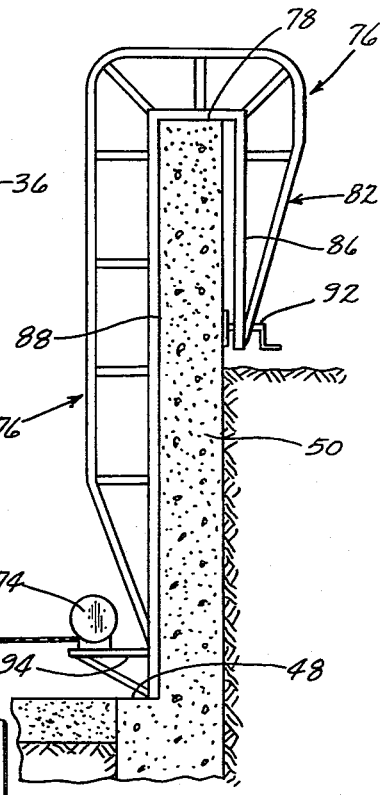
FIG. 4 is a side, partially sectional view of the inverted J-shaped winch support apparatus for advancing the screed across a surface.

To advance the entire screed assembly 66 across the newly poured concrete 56 in the direction of arrows 68 in FIG. 2, a Y-shaped winch cable 70 is secured to the forward screed member 12 at transversely spaced-apart positions such as at the bolts 60 with the trailing end 72 of the cable being drawn onto a winch indicated generally at 74. To securely anchor the winch along the interior side of a transverse foundation wall 50, the invention provides an inverted J-shaped standard 76 adapted for support on the upper surface 78 (FIG. 4) of foundation wall 50. Standard 76 includes a pair of transversely spaced-apart truss structures 80 and 82, as indicated in FIG. 2, which are connected by a plurality of suitable cross members 84. Each truss structure includes a short leg 86 as indicated in FIG. 4 and a long leg 88 adapted to lie flush against the interior surface of foundation wall 50. A clamp plate 90 (FIG. 2) extends between the lower ends of the short legs 86 and carries a pair of screw-type clamp fixtures thereon for securing the standard 76 onto the foundation wall. The lower ends of the long legs 88 carry a generally horizontal platform 94 to which the winch 74 is secured, as shown best in FIG. 4.

In operation, the method of smoothing and finishing a newly poured concrete surface according to the present invention may include the following steps. The elongated screed members 12 and 14 are secured at one end to the upstanding plate 10 as described above. The screed members and plate are then arranged onto the newly poured surface with the plate 10 in parallel adjacent relation to the foundation wall and the bottom edge 24 supported on the horizontal surface 48. It is assumed that the other ends of the screed members 12 and 14 are suitably supported either by conventional means or by a second upstanding plate according to the invention. The Screed members 12 and 14 and then vibrated by the motor 64 and advanced across the concrete 56 by winch 74 with the upstanding plate 10 sliding along the horizontal surface 48. It can be seen in FIG. 2 that the upstanding plate 10 is maintained in uniformly spaced relation from the foundation wall 50 by the spacer bar 42. As the screed assembly 66 is advanced across the concrete, the thin upstanding plate 10 cuts through the concrete displacing only a minimum of material. Since the plate terminates forwardly of rearward screed member 14, that member smooths the concrete behind the plate 10 so as to leave no trace of its passage. Likewise, the outward portion 40 of screed member 14 smooths that portion of the concrete which lies between the plate 10 and foundation wall 50. The downwardly and forwardly tapered leading edge 20 of plate 10 prevents the plate from riding up on obstructions such as stones which may lie along the footing 48 and thereby maintains the plate in engagement with the footing so that the screed members are maintained at a uniform desired height.

It is to be understood that the term foundation wall is used only by way of example. The use of plate 10 is not limited to floors poured at the base of a foundation wall. It can be used as well for floors poured at the top of a foundation wall or adjacent any other upright form having an adjacent inner surface on which the plate can slide. For example, a slab may be poured up to the exterior wall of an existing building. A 2×2 length of lumber may be secured to or adjacent the building wall as the horizontal surface on which plate 10 can slide.

Thus there has been shown and described an improved apparatus and method for smoothing and finishing a newly poured concrete surface which accomplishes at least all of the stated objects.

I claim:

1. An apparatus for supporting an elongated screed member comprising, an upstanding support member, and means for operatively connecting said support member to a screed member adjacent one end thereof such that said support member is disposed generally perpendicular thereto and is spaced from said one end thereof with portions of said screed member disposed on opposite sides of said support member, said support member having a substantially flat bottom edge adapted to be positioned below said screed member.

2. The apparatus of claim 1 wherein said support member comprises a generally flat plate.

3. The apparatus of claim 2 wherein said plate has a leading edge which tapers forwardly and downwardly toward said bottom edge.

4. The apparatus of claim 2 further comprising an open bottomed channel secured to the plate in perpendicular relation thereto, said channel being adapted to receive said screed member.

5. The apparatus of claim 4 wherein said open bottomed channel is positioned in registration with an opening through said plate whereby a screed member received in said channel extends through said opening.

6. The apparatus of claim 4 wherein said means for operatively connecting said support member to said screed member comprises holes in said channel for the insertion of fastening means therethrough.

7. The apparatus of claim 2 wherein said plate includes means for supporting one end of a second elongated screed member at a position forwardly of said channel.

8. The apparatus of claim 7 wherein said means for supporting one end of a second elongated screed member comprises a second open bottomed channel secured at one end to the plate and extended perpendicularly therefrom.

9. The apparatus of claim 2 wherein said plate has an inwardly facing side and an opposite outwardly facing side and further comprising a spacer bar having a forward end which is inclined rearwardly and outwardly from said plate, a rearward end adapted to operatively engage said screed member adjacent one end thereof and an intermediate portion connecting said forward and rearward ends, said intermediate portion being parallel to said plate and spaced therefrom.

10. A screed for smoothing and finishing a newly poured surface adjacent an upright form having an adjacent inwardly extended generally horizontal surface, comprising, an upstanding plate, a pair of elongated screed members, said screed members being supported in generally parallel spaced-apart relation, means for securing said screed members to said plate at a position such that the plate extends below said screed members, said plate having a generally flat bottom surface adapted for sliding movement along said horizontal surface, and said upright plate including a forward portion adapted for engagement against the end of one screed member and a rear portion adapted for connection to the other screed member adjacent one end thereof such that the support member is spaced from said one end of the other screed member with portions of said other screed member disposed on opposite sides of said support member.

11. The screed of claim 10 further comprising means for advancing said screed in a direction parallel to the upright form.

12. The apparatus of claim 11 wherein said upright form comprises a foundation wall and said means for advancing the screed comprises an elongated cable operatively connected to said screed at transversely spaced-apart positions, a winch for drawing in said cable in the direction of advancement, and a winch support apparatus comprising an inverted J-shaped standard adapted for support on said foundation wall, said winch secured to a lower portion of said standard.

13. The apparatus of claim 12 wherein said inverted J-shaped standard includes a long leg and a short leg, said winch being connected to a lower end of said long leg, and a clamp means on said short leg for engaging a foundation wall.

14. A method of smoothing and finishing a newly poured surface adjacent an upright form having an inwardly extended generally horizontal surface, comprising, providing a pair of elongated screed members secured in generally parallel spaced-apart relation, supporting one end of said screed members on an upstanding plate having a flat bottom surface, arranging said plate in parallel relation to the upright form with the flat bottom surface supported on the horizontal surface, supporting the other end of said screed members at a height approximately level with said one end, maintaining said plate in uniformly spaced relation from the form whereby a portion of said poured surface lies between said plate and said form, and advancing said screed members across said surface and thereby simultaneously sliding said plate along the horizontal surface.

15. The method of claim 14 further comprising vibrating said screed members.

16. The method of claim 14 further comprising extending one of said screed members through said plate to engage that portion of the poured surface between the plate and the form.

* * * * *